US010683688B2

(12) United States Patent
Nußbaum

(10) Patent No.: US 10,683,688 B2
(45) Date of Patent: Jun. 16, 2020

(54) FOLDING DEVICE WITH ADJUSTING STRIP

(71) Applicant: Solarlux GmbH, Melle (DE)

(72) Inventor: Björn Nußbaum, Osnabrück (DE)

(73) Assignee: Solarlux GmbH, Melle (DE)

( * ) Notice: Subject to any disclaimer, the term of this patent is extended or adjusted under 35 U.S.C. 154(b) by 295 days.

(21) Appl. No.: 15/848,340

(22) Filed: Dec. 20, 2017

(65) Prior Publication Data

US 2018/0179798 A1 Jun. 28, 2018

(30) Foreign Application Priority Data

Dec. 23, 2016 (DE) ..... 10 2016 125 605

(51) Int. Cl.
*E06B 3/48* (2006.01)
*E05D 15/26* (2006.01)
(Continued)

(52) U.S. Cl.
CPC ..... *E05D 15/26* (2013.01); *E05D 7/0423* (2013.01); *E06B 3/26301* (2013.01);
(Continued)

(58) Field of Classification Search
CPC .. E06B 3/26301; E06B 3/26303; E06B 3/481; E06B 7/22; E06B 7/2309;
(Continued)

(56) References Cited

U.S. PATENT DOCUMENTS 1,230,345 A * 6/1917 Urmson ..... E05D 15/266 160/206
1,750,921 A * 3/1930 Bright ..... E06B 1/08 52/217
(Continued)

FOREIGN PATENT DOCUMENTS

DE 93 10 418 11/1993

OTHER PUBLICATIONS

Haberbauer H. et al.: Maschinenelemente-Gestaltung, Berechnung, Anwendung; 5—Elemente der geradlinigen Bewegung; Springer-Verlag Berlin Heidelberg, Germany , 2009, pp. 429-431—ISBN 978-3-540-68611-8 Fig. 5.2. shows attachment variants of adjusting strips (4 in Fig. 5.1.) to compensate clearance in linear guides shown in Fig. 5.1.

*Primary Examiner* — Katherine W Mitchell
*Assistant Examiner* — Abe Massad
(74) *Attorney, Agent, or Firm* — Gudrun E. Huckett

(57) ABSTRACT

A folding device as room closure has a frame and a chain of panels arranged therein. The panels are pivotably connected by alternate first and second hinge arrangements and foldable from a stretched-out closed position into an open accordion fold arrangement. First hinge arrangements are guided on guide rails of the frame; second hinge arrangements are deflected away from the frame. In the closed position, the panels are sealed relative to each other and to the frame by frame seals extending at least partially along a sealing plane. An adjusting strip in front of a lateral frame part is adjustable to adjust a spacing between adjustable strip
(Continued)

and lateral frame part for spatial adaption to an adjacent panel. The adjusting strip has a sealing contact surface aligned with the sealing plane and resting against a seal arranged on the lateral frame part and extending into the guide rails.

15 Claims, 5 Drawing Sheets

(51) Int. Cl.

| | |
|---|---|
| ***E05D 7/04*** | (2006.01) |
| ***E06B 7/23*** | (2006.01) |
| ***E06B 3/263*** | (2006.01) |
| ***E06B 7/22*** | (2006.01) |
| *E05D 5/02* | (2006.01) |

(52) U.S. Cl.
CPC ..... *E06B 3/481* (2013.01); *E06B 7/22* (2013.01); *E06B 7/2309* (2013.01); *E05D 5/023* (2013.01); *E05Y 2800/12* (2013.01); *E05Y 2900/132* (2013.01); *E05Y 2900/142* (2013.01); *E06B 3/26303* (2013.01)

(58) Field of Classification Search
CPC ..... E06B 7/18; E05D 15/26; E05D 7/0423; E05D 5/023
USPC ..... 49/482.1
See application file for complete search history.

(56) References Cited

U.S. PATENT DOCUMENTS

| | | | | | |
|---|---|---|---|---|---|
| 2,699,578 | A * | 1/1955 | Marks | E06B 1/08 | 49/399 |
| 3,111,208 | A * | 11/1963 | Grossman | A47K 3/30 | 49/396 |
| 3,235,915 | A * | 2/1966 | Glaser | E05D 15/0608 | 52/64 |
| 3,300,899 | A * | 1/1967 | Haws | E04B 2/827 | 49/321 |
| 3,553,891 | A * | 1/1971 | Casebolt | A47K 3/36 | 49/505 |
| 5,123,129 | A * | 6/1992 | Lyons | A47K 3/36 | 16/390 |
| 6,874,286 | B2 * | 4/2005 | Tavivian | E06B 1/02 | 49/505 |
| 9,487,985 | B2 * | 11/2016 | Conley | E06B 3/924 | |

* cited by examiner

FOLDING DEVICE WITH ADJUSTING STRIP

BACKGROUND OF THE INVENTION

The invention relates to a folding device, in particular glass folding device (e.g. bi-folding glass doors), for room closures or room dividers that can be opened, for use in connection with sunrooms, store fronts, balcony glass enclosures or similar applications. The folding device comprises a peripheral frame comprising a top guide rail and a bottom guide rail and lateral frame parts connected thereto as well as a chain of panels that are connected pivotably to each other and that, when opening the folding device, can be folded against each other in an accordion fold arrangement. Hinge arrangements between the panels are alternatingly disposed such that first ones are guided on the guide rails and second ones are deflected outwardly in a direction transverse to the guide rails. When closing the folding device, the panels are moved into a stretched-out position and form together with the peripheral frame a closed wall structure within which the panels are closed by seals relative to each other and relative to the peripheral frame, wherein the seals between the panels and the peripheral frame at least partially extend along a sealing plane. At least one of the lateral frame parts has disposed in front thereof, viewed in a direction of extension of the guide rails, an adjusting strip wherein the adjusting strip, for adaptation to an end edge of the panels in the stretched position, is embodied to be adjustable with regard to the spacing relative to the lateral frame part.

Folding devices are common in practice that have at least one chain of panels, the panels connected pivotably to each other and, from the closed position within the peripheral frame, foldable in an accordion fold fashion in such a way that hinge arrangements between the panels alternatingly are guided along the guide rails and deflected outwardly by a folding movement oriented away from the rails. Often, the chain of panels at one end is stationarily connected to the lateral frame part but is pivotable and the chain of panels can be folded toward this end. In this context, the chain of panels at the opening side can terminate with a hinge arrangement which is guided along the guide rails or can terminate by means of a (rotary) panel that pivots like a door. When being folded, the chain of panels can also be freely movable as a whole along the guide rails and can thus be folded toward one end or the other end of the guide rails wherein also freely pivotable end panels on both sides can be provided.

In the closed position, it is important that the stretched-out chain of panels is closed seal-tightly between the panels and also seal-tightly relative to the peripheral frame. While the seals to be provided relative to each other and relative to the guide rails and lateral frame parts can be employed in conventional and practice-proven manner, an adjusting strip that is positioned in front of one or both of the lateral frame parts presents a problem due to its adjustability in regard to the spacing relative to the lateral frame part. Such an adjusting strip is provided in order to compensate tolerances in regard to the length of the chain of panels in the closed state; tolerances may accumulate, based on manufacturing and mounting tolerances of the individual panels, to a value of several millimeters and such tolerances are difficult to avoid in practice. In particular at the transition locations to the guide rails, these tolerances present problems in regard to being able to provide continuous seals, despite of the spacing adjustment of the adjusting strip relative to the lateral frame parts, without resorting in this context to unappealing voluminous seals or requiring changes in the seal for each new adjustment of the adjusting strip.

SUMMARY OF THE INVENTION

It is an object of the invention to design a folding device with a pleasing appearance in line with the market that is optimized with minimal expenditure in regard to the sealing action.

In accordance with the invention, this is achieved in that in the folding device of the aforementioned kind the adjusting strip is provided with a sealing contact surface which is aligned with the sealing plane between panels and peripheral frame and is in contact with a seal that is arranged on the neighboring lateral frame part and continues into the adjoining guide rails.

In this way, an uninterrupted sealing action within the sealing plane between peripheral frame and panels is enabled which includes the adjusting strip and, in case of a change of the spacing of the adjusting strip relative to the lateral frame part, maintains its shape and position. With a sealing contact surface which is aligned with the sealing plane between the panels and the peripheral frame, the prerequisite is provided for placing the adjusting strip against a continuous seal and for maintaining its sealing seat independent of spacing changes of the adjusting strip relative to the lateral frame part. In this way, there is also the possibility of providing a continuous and seamless seal that is stationarily guided in the peripheral frame, continues into the adjoining guide rails, and can even extend continuously, as needed, even monolithically (one piece), about the entire peripheral frame. A displacement of the adjusting strip along the sealing plane leaves the sealing seat untouched. Such a configuration can also be accommodated in a slim frame shape in line with the market and is also beneficial in regard to the demands for a labor-saving and simple installation and adjustment of the adjusting strip. The sealing plane that is considered in this context is the contact surface between the peripheral frame and the movable panels and also the movable adjusting strip; the sealing plane passes, without displacement and without gap, from the lateral frame parts that hold the adjusting strip into the guide rails and can extend as a closed annular surface about the entire peripheral frame.

The adjusting strip as a whole is preferably embodied between sealing plane and an outer surface of the lateral frame part so as to have a width that is reduced relative to the width of the peripheral frame (viewed in the direction of the guide rails) and covers thus, relative to the adjoining panel, only a portion of the lateral frame part located between the sealing plane and one of the outer surfaces of the folding device.

In this context, the adjusting strip can form expediently with a surface opposite the sealing contact surface an exterior surface and thus can appear to be part of the lateral frame part.

Advantageously, between the adjusting strip and the abutting panel, on one end or the other end or even on both ends, a seal can be arranged which is matched expediently to the respective oppositely positioned end of the adjusting strip or the abutting panel.

For providing an adjusting strip that can be properly moved along the sealing plane, the adjusting strip can expediently be designed as a profiled section with guiding surfaces formed on profiled section stays for guiding relative to the lateral frame part wherein the guiding surfaces are provided on the profiled stays. Such profiled sections can be produced, even in case of complex shapes, in a pleasing and robust design as light metal sections, in particular of aluminum or an aluminum alloy.

The lateral frame part can also be designed as a profiled section and the adjusting strip can be supported in a chamber of the profiled section, wherein the chamber is open in the direction of extension of the guide rails. While the adjusting strip can be manufactured as a monolithic part of light metal when it is positioned only partially on an outer surface of the folding device, in case of a lateral frame part made of light metal sections it is usually necessary to prevent the creation of thermal bridges and, for this purpose, the profiled section element must be constructed to include a plastic profiled section, for example, in the interior.

For its adjustability, the adjusting strip can be connected in a practice-oriented way by means of adjusting screws to the lateral frame part, wherein generally a plurality of adjusting locations are required. In this respect, in case of adjusting strips with inherent stiffness, only two adjusting devices distributed across the entire length of the adjusting strips may suffice for adjustment of the spacing relative to the lateral frame part or for contact adjustment relative to the abutting panel. In general, however, across the length of an adjusting strip adjusting screws are provided at three adjusting locations along the adjusting strip.

BRIEF DESCRIPTION OF THE DRAWING

Two embodiments of the invention are illustrated in the drawings and will be explained in the following in more detail.

DESCRIPTION OF THE PREFERRED EMBODIMENTS

Figure 1:
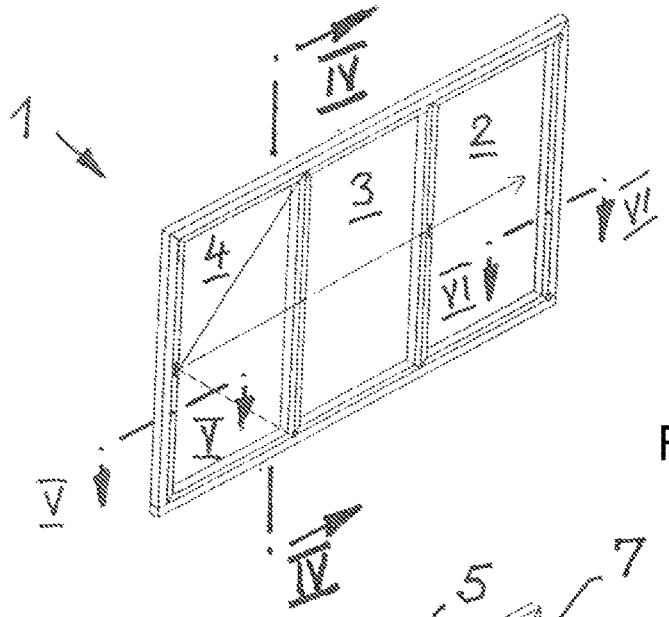
FIG. 1 is a schematic representation of a folding device in the closed position.
Figure 2:
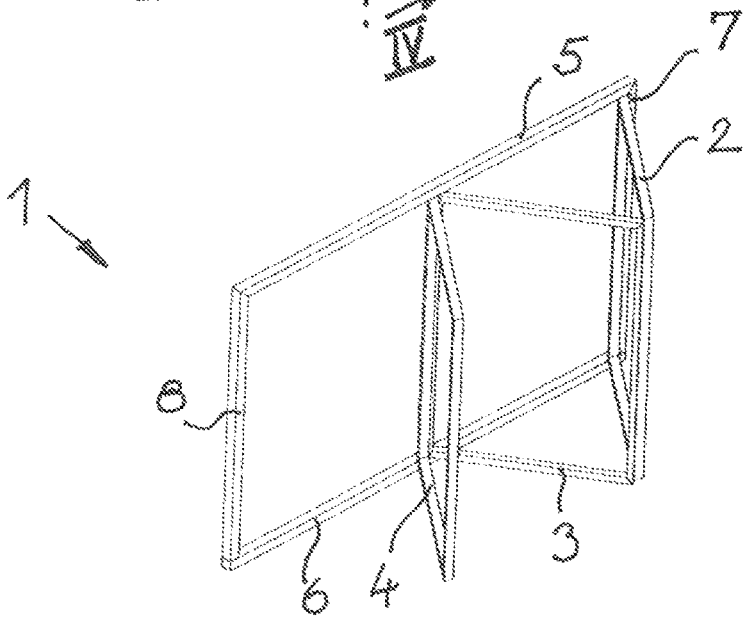
FIG. 2 is a schematic representation of the folding device as it is being opened.
Figure 3:
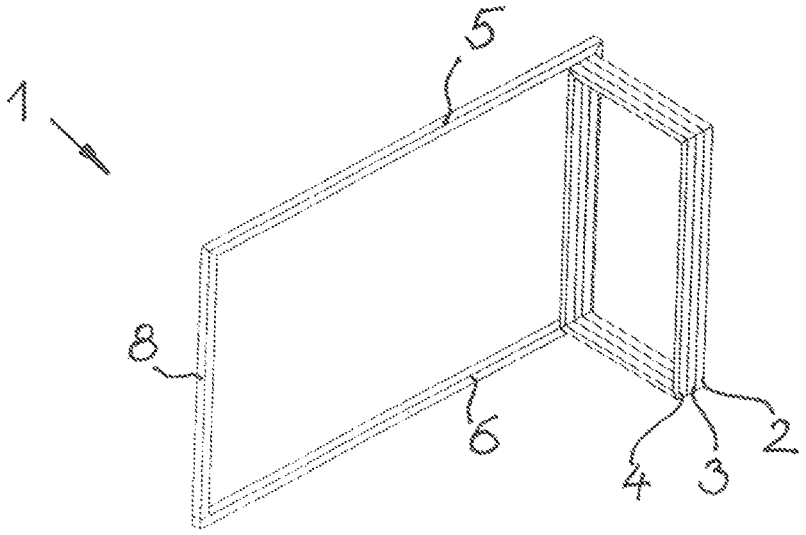
FIG. 3 is a schematic representation of the folding device in the open folded position.

A folding device, in particular a glass folding device (bi-folding glass doors) 1, is illustrated in FIGS. 1, 2, and 3; for clarity, it is shown in an elementary form with three panels 2, 3, 4. The closed state is shown in FIG. 1, a partially open state in FIG. 2, and the open, folded state in FIG. 3. The panels, 2, 3, 4 are supported in a peripheral frame comprised of a top guide rail 5, a bottom guide rail 6, a lateral frame part 7, and a lateral frame part 8 opposite the lateral frame part 7. The panel 2 is secured with one end to the lateral frame part 7 and to the guide rails 5, 6 in such a way that the panel 2 is rotatable but non-slidable. The panels 2 and 3 are pivotably connected to each other but without their pivot connection being secured on the guide rails 5 and 6. The panels 3 and 4 are connected pivotably to each other but in the area of the hinge arrangement are guided along the guide rails 5 and 6. The panel 4 is a "rotary" panel and pivotable about the intermediate hinge arrangement relative to and toward the panel 3 and, for example, in case of a folding device that reaches all the way up to the ceiling, can also be opened and used as a door.

In a glass folding device, the panels are comprised, as is known in the art, of glass (double glazing; double pane) and are framed by panel frames. It is understood that folding devices of this kind can be expanded as desired with additional foldable panel pairs, like the pair of panels 2 and 3, that are folded and guided along the guide rails 5 and 6. As is known in the art, a folding device of this kind can also be slidable as a whole along the guide rails without having one (usually the terminal) panel fastened to one of the lateral frame parts. Also, the chain of panels can be designed to have on either side a "rotary" panel like the panel 4 that can freely pivot. Such folding devices are in principle known in the art. This holds true substantially also for the (partial) cross section illustrations according to FIGS. 4 through 6 which are only presented here to assist in understanding the invention and will be explained in the following.

Figure 4:
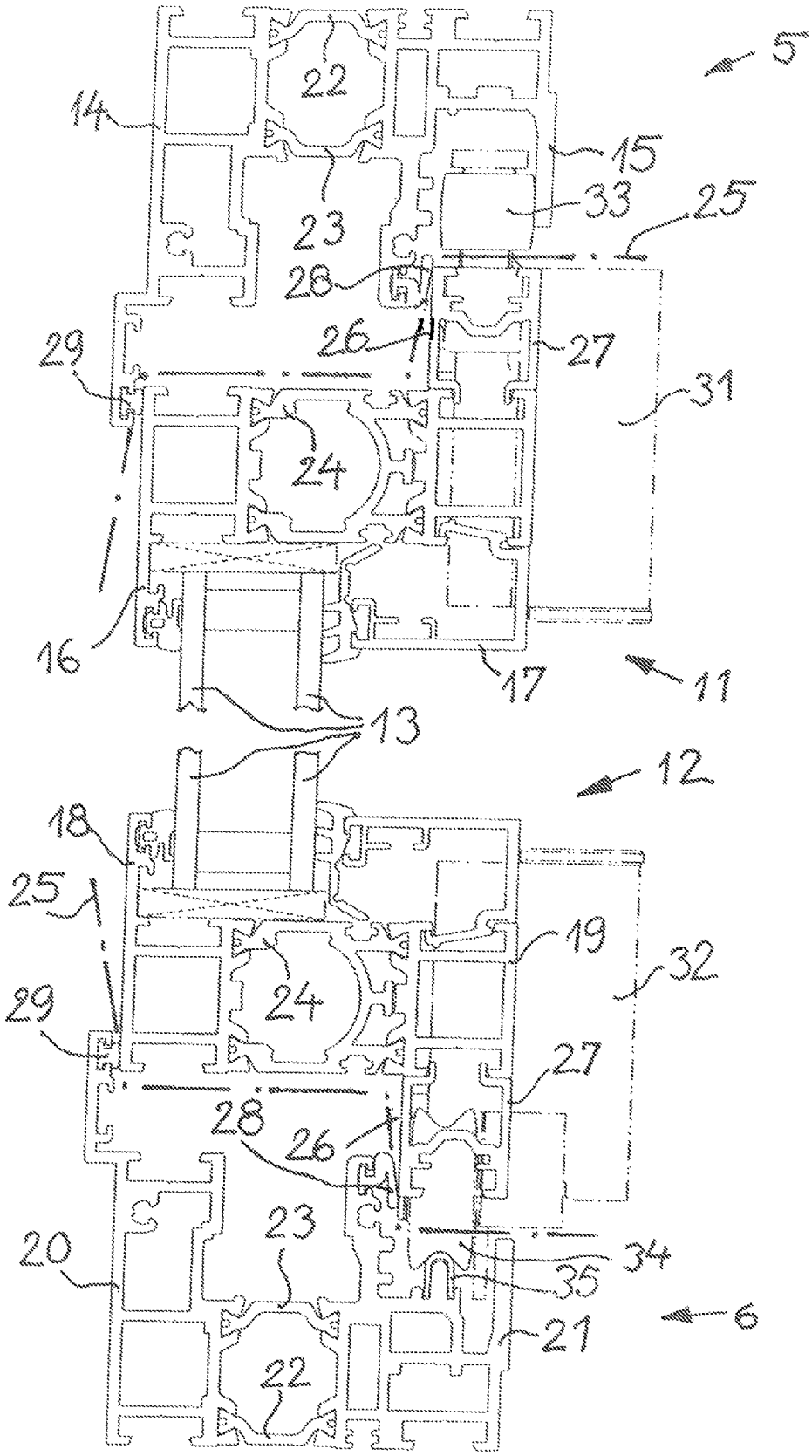
FIG. 4 is a partial section view according to section line IV-IV of FIG. 1 with the center part broken away.

FIG. 4 shows a vertical cross section of the top and bottom guide rails 5 and 6 of the peripheral frame and the top and bottom panel frames 11, 12 which are contacting the guide rails 5, 6 in the closed state of the folding device; the intermediately positioned double glazing element 13 is represented only partially and is substantially broken away in the illustration. In any case, the invention is independent of the filling (glazing) of the panels and of the inner surface of the panels, even though, in particular in case of double glazing, it is of primary interest to the user.

The aforementioned frame parts according to common practice are designed as complex extruded section parts, in particular in an assembled form with external section parts that, for reasons of strength, robustness, and pleasing appearance of the surface, are produced of metal, i.e., extruded sections of an aluminum alloy. However, in a central area, they are secured by section anchors 22, 23, 24 which are made preferably of plastic material in order to prevent thermal bridges. In this context, the profiled sections of the peripheral frame as a whole form rabbets between frame and panels where the panels can abut transverse to the peripheral frame, as is known from door or window rabbets. The separations between panels and peripheral frame are indicated with dash-dotted separating lines 25. Important in this context is the configuration of a sealing plane 26 which in FIG. 4 is extending along a lateral surface of a profiled section part 27 of the panel frame 11 or 12, projecting in the peripheral frame plane, and along a seal 28 supported on the guide rails 5, 6. The sealing plane 26 is positioned within the cross section of the frame sections and is aligned with the corresponding contact surface of the panel frames parallel to the plane of a peripheral frame of planar configuration. Accordingly, the correlated seal 28 is substantially designed for a seal-tight contact transverse to the peripheral frame plane even when the sealing section provides also mobility parallel to the peripheral frame plane.

The cross sections of the profiled sections according to FIG. 4 also show additional seals 29 between the guide rails 5 and 6 and the panel frames; the seals 29 are positioned externally and provide protection against dirt and moisture for the intermediate areas between peripheral frame and panel. In practice, these seals 29 are however not designed for forming a sealing plane, in particular because they are bridged and vented by bottom-side venting and drainage openings (not illustrated). The seals 29 have thus only a protective function in front of the inwardly positioned seals at the sealing plane 26.

In FIG. 4, moreover hinges 31, 32 at the panel frames 11 or 12 (and at the adjoining panel frames) of the panel 2 for forming a hinge arrangement are indicated in dash-dotted lines. The top hinge 31 is connected to a guide roller 33 with vertical axis which is running in a downwardly open cavity of the frame section part 15 for guiding transverse to the peripheral frame plane while the bottom hinge 32 supports a roller 34 with a running profile which is running on a profiled rail 35 and partially transmits the weight of the panel to the guide rail 6 and at the same time provides a guiding action along the peripheral frame. According to FIG. 1, the hinges of the panels are positioned behind the section plane IV-IV of FIG. 4.

Figure 5:
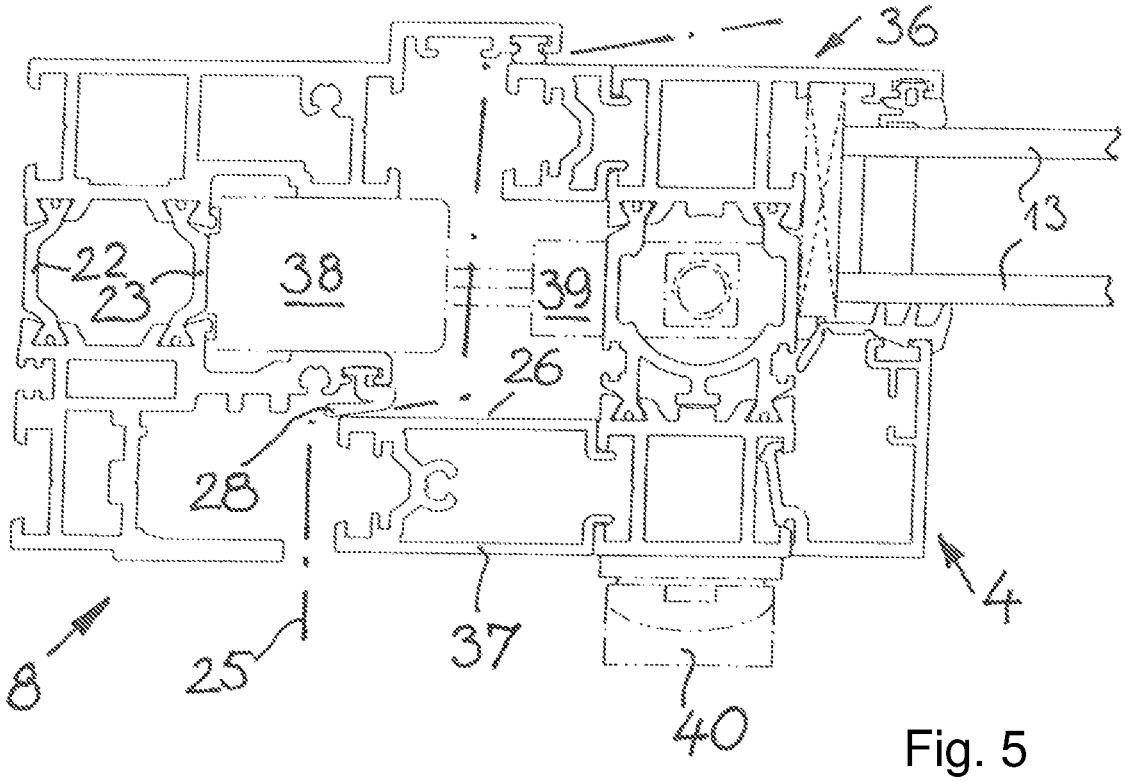
FIG. 5 is a partial section view according to section line V-V of FIG. 1.

According to FIG. 5, the closed position between the (rotary) panel 4 and the lateral frame part 8 is designed very similar to the configuration disclosed with the aid of FIG. 4 between the panel 3 and the guide rails 5, 6 and is also realized with partially corresponding extruded sections. For reasons of clarity, here also a dash-dotted line 25 is indicated to show the separation between the lateral frame part 8 and panel frame 36 wherein a projecting section part 37 of the panel frame 36 at the inner side forms a contact plane that is a continuation of the sealing plane 26 and together with this sealing plane 26 is resting against a seal supported on the peripheral frame which, as a continuous seal, can be em bodied along the entire peripheral frame in order to avoid gaps. Also, possible joints or seams where sealing members are to be joined, can be reliably closed in the meaning of a continuous seal.

In FIG. 5, in dash-dotted lines also closing elements 38, 39 as well as a knob-shaped actuating grip 40 are indicated which provide the door lock functions for a rotary panel to be used like a door.

Figure 6:
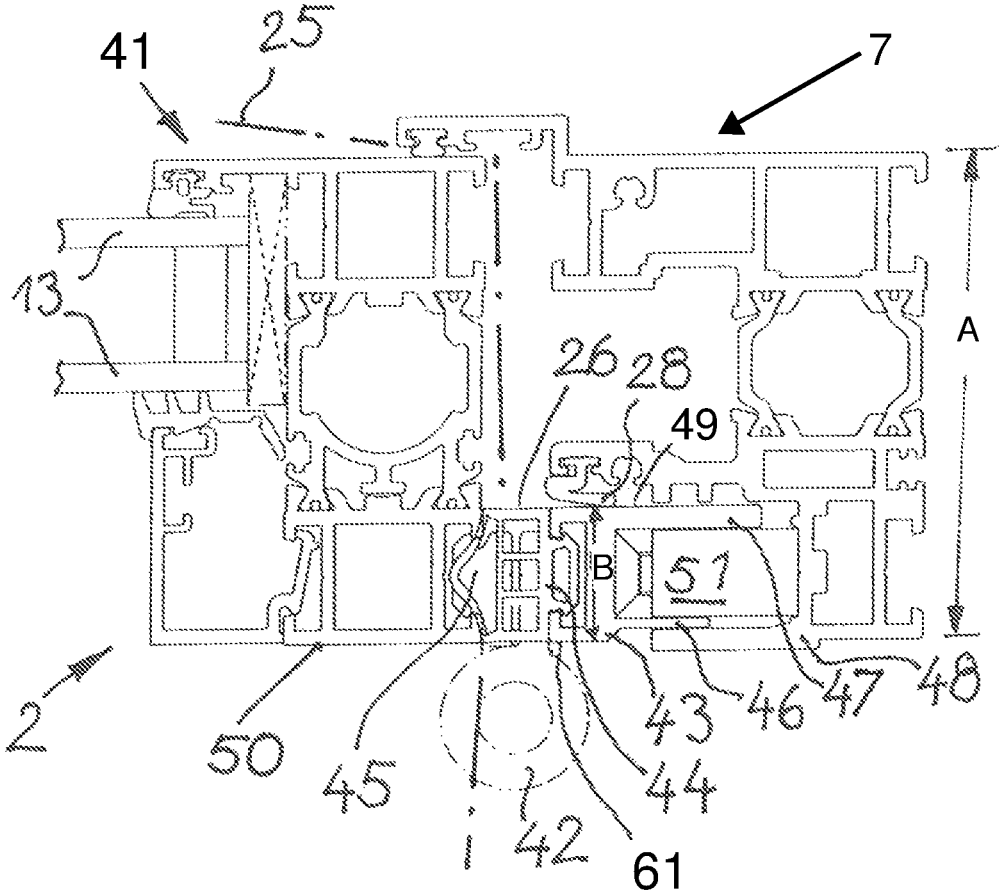
FIG. 6 is a partial section view according to section line VI-VI of FIG. 1.
Figure 7:
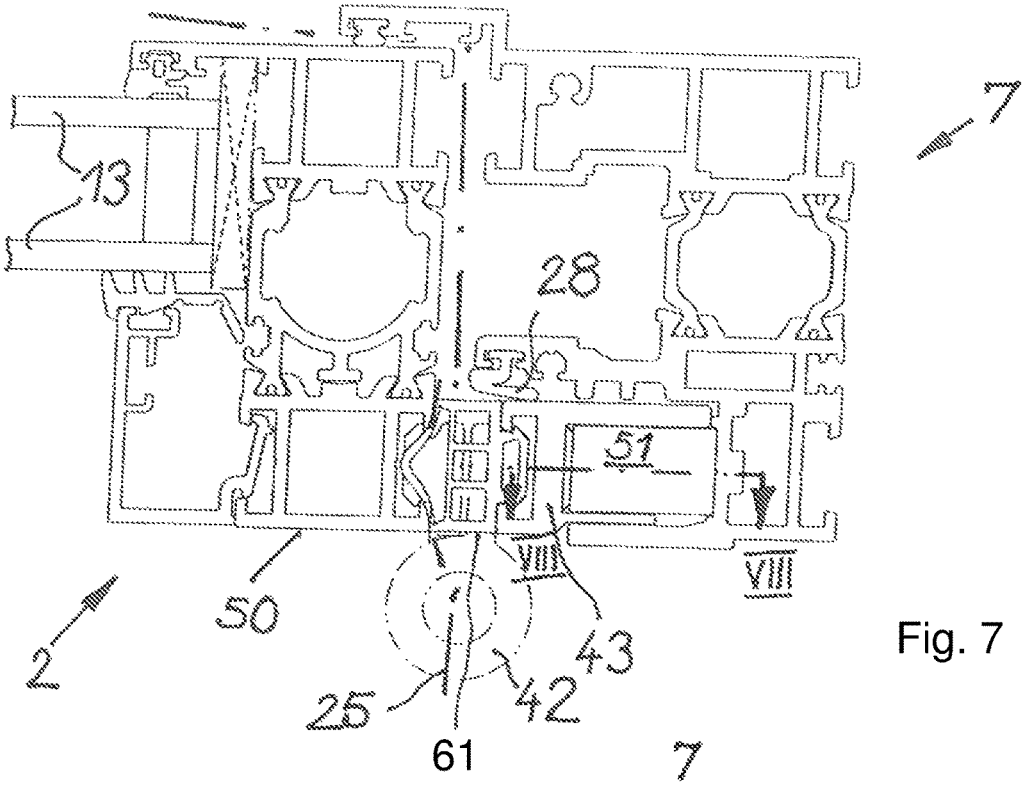
FIG. 7 is a partial section view corresponding to FIG. 6 with adjusting strip adjusted in comparison to FIG. 6.

In FIGS. 6 and 7, the correlation of the lateral frame part 7 to a panel frame section 41 of the panel 2 is illustrated which like the afore described frame parts is assembled substantially of extruded sections. Relative to the peripheral frame, the panel 2 is supported pivotably by means of a door hinge or pivot 42 which in the present case is not movable in the direction of the guide rails on rollers; rollers may however be provided as an alternative.

In comparison to the afore described embodiment, it is important that an adjusting strip 43 is provided that is preferably embodied as an extruded metal section and is provided at the front side with a C-groove 44 for receiving an end face seal 45. Profiled section stays 46, 47 of the adjusting strip 43 extend in a U-shape parallel to each other to the rear and are mounted with a predetermined movement clearance in a cavity 48 of the lateral frame part 7 that is open at one side. They provide a movability relative to the lateral frame part 7 in the direction toward the panel 2. This adjusting possibility is important for the exact adaptation of the closed chain of panels relative to the peripheral frame in order to compensate manufacturing tolerances of the chain of panels, which in particular for a large number of panels in the chain can amount to a significant value, as well as manufacturing tolerances of the peripheral frame and, as needed, deformations that may occur in use. For this purpose, the adjusting strip 43 is adjustable about an adjusting range of, for example, 10 mm toward the panel 2 and also away from the panel 2 so that the seal 45, with sealing seat on the panel 2, will close in a precisely predetermined way without having to accept the risk of a sealing seat that is too loose or squeezed improperly.

A particular problem resides in that the sealing action between peripheral frame and panel must be ensured for positional changes of the adjusting strip. This is achieved in that the adjusting strip 43 comprises a sealing contact surface 49 which is aligned with the sealing plane 26 between panel and peripheral frame and which does not move upon adjustment of the adjusting strip 43. A frame seal, i.e., the seal 28, which therefore as a whole can extend as a closed sealing ring about the entire peripheral frame, engages seal-tightly this sealing contact surface 49. The sealing plane 26 in the present example is provided with a planar frame but can also be curved, for example, in an arc shape, as long as in this context gaps or projections are avoided.

The adjusting strip 43 as a whole together with its end face seal 45 is limited to a partial width B of the entire width A of the lateral frame part 7 between the inwardly positioned sealing plane 26 and an outer surface 50 which is trailing upon closing the panel 2 and is aligned with this outer surface by means its exterior surface 61.

The sealing plane is thus displaced inwardly away from the outer surfaces and contacts and closes seal-tightly with the seal 28 the movable panels 2, 3, 4 as well as the adjusting strip 43.

Figure 8:
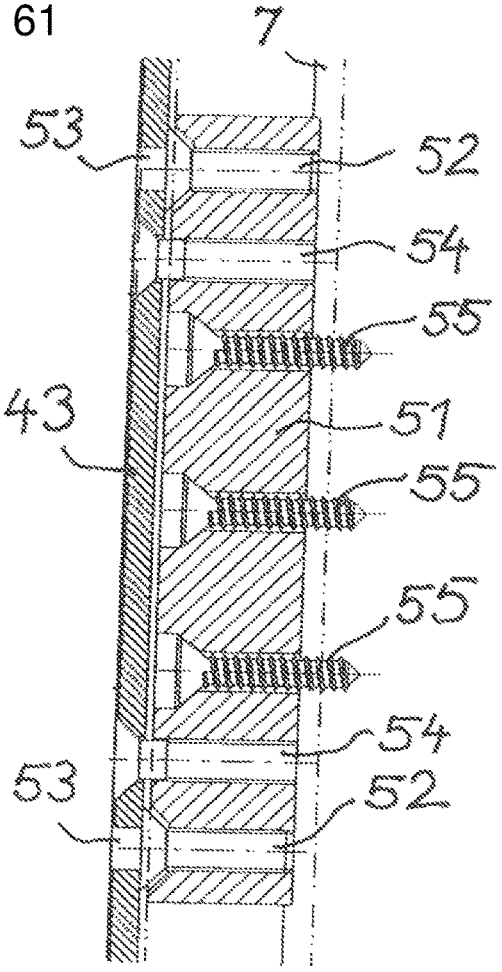
FIG. 8 is a partial section view according to section line VIII-VIII of FIG. 7.

In FIGS. 6 and 7, two different adjusting positions of the adjusting strip 43 are shown wherein the illustration of FIG. 7 shows a completely retracted end position of the adjusting strip 43. The positions are adjusted, for example, by consoles 51 by means of screws which can be seen in FIG. 8. The consoles 51 are blocks with threaded bores in which at least one threaded bore receives a threaded screw 52 as a support which through an access opening 53 in the adjusting strip 43 is accessible for tool engagement for adjustment. The adjusting screw 52 forms with the screw head a support for the adjusting strip 43 and determines thus the spacing relative to the lateral frame part 7. An adjusting screw 54 is also extending through a threaded bore of the console 51 but with the screw head supported on the adjusting strip 43 in a depression which is recessed in the adjusting strip 43. The adjusting screw 54 secures the adjusting strip 43 on the head of the adjusting screw 52. Both screws 52, 54 are adjustable. The illustrated console 51 comprises at its bottom end corresponding adjusting screws 52 and 54. The adjusting strip 43 is in turn fixedly secured on the lateral frame part 7 by means of fastening screws 55.

The number of consoles 51 across the vertical length of the adjusting strip 43 is to be predetermined based on practical considerations taking into account the inherent stiffness of the adjusting strip. While principally a proper alignment of the adjusting strip 43 relative to the panel 2 can already be achieved by two consoles 51 that are spaced apart from each other, three or even more consoles 51 distributed along the adjusting strip 43 can be advantageous for its (intermediate) support.

The adjustment of the adjusting strip 43 is not limited to the afore described embodiment with consoles 51. Adjusting mechanisms of different kinds which are preferably provided with hidden access openings, for example, the access openings 53 in the adjusting strip 43, are also usable in this context.

Figure 9:
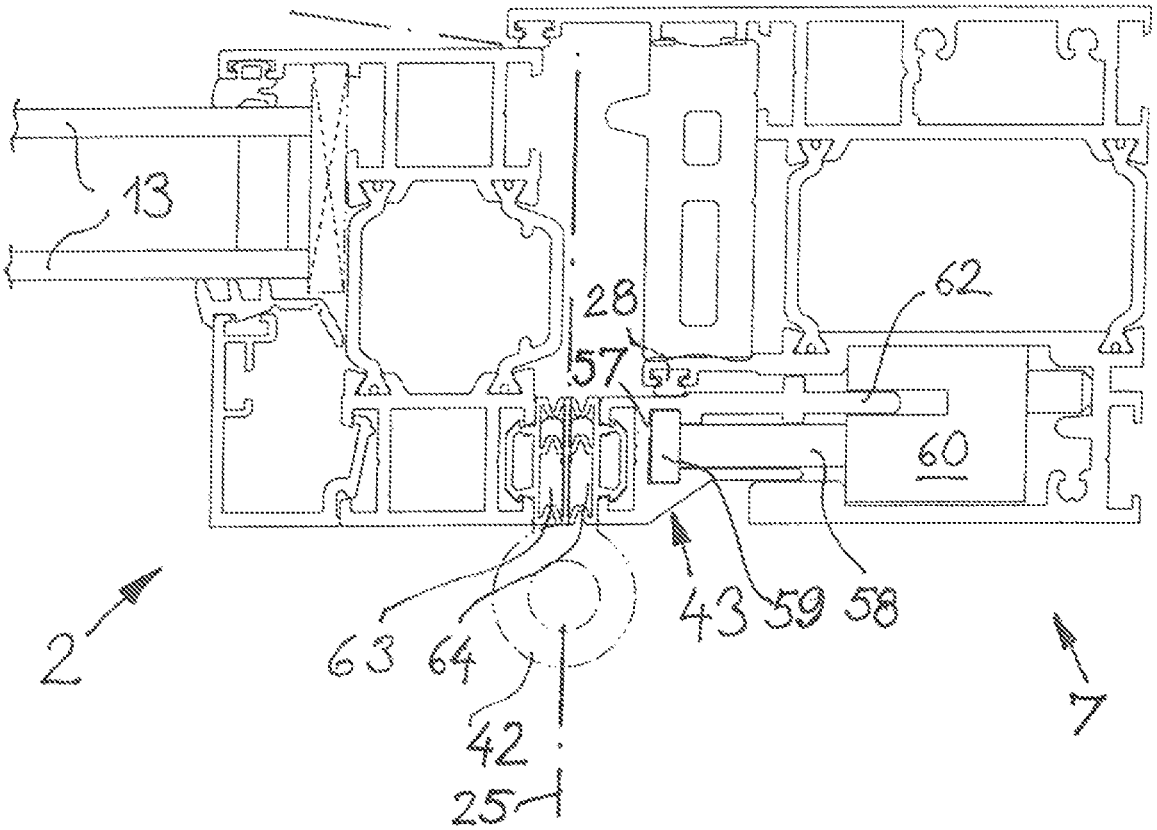
FIG. 9 is a partial section view corresponding to FIG. 7 of a modified embodiment of the invention.

A simplified adjusting device for the adjusting strip 43 is shown in FIG. 9 wherein the adjusting strip 43 then is to be provided with a C-shaped inner section 57 into which a head screw 58 with a head 59 is to be inserted with little or no clearance. The head screw 58 is to be screwed with a thread into a console 60 and to be moved in the adjusting direction by turning so that an adjustment in both adjusting directions is possible with a single screw per console 60. The adjusting strip 43 is guided in turn with tight fit in the lateral frame part 7 and moves with a rear stay 62 also in a matching slot in the console 60 in order to prevent transverse movements and rotations in the meaning of canting. For sealing between the end face of the adjusting strip 43 and an oppositely positioned end edge of the panel 2, end face seals 63, 64 are provided at both ends and are provided with mirror-image cross section and contact surfaces extending along the separation line 25.

The specification incorporates by reference the entire disclosure of German priority document 10 2016 125 605.6 having a filing date of Dec. 23, 2016.

While specific embodiments of the invention have been shown and described in detail to illustrate the inventive principles, it will be understood that the invention may be embodied otherwise without departing from such principles.

What is claimed is:

1. A folding device configured as an openable room closure or an openable room divider, the folding device comprising:

a peripheral frame comprising a top guide rail, a bottom guide rail, a first lateral frame part, and a second lateral frame part opposite the first lateral frame part, wherein the first and second lateral frame parts connect the top guide rail and the bottom guide rail to each other;

a chain of panels comprising a plurality of panels arranged in the peripheral frame and pivotably connected to each other by hinge arrangements so as to be foldable relative to each other from a stretched-out closed position, in which the peripheral frame and the panels together form a closed wall, into an open folded position in which the panels are positioned in an accordion fold arrangement;

wherein the hinge arrangements include first hinge arrangements and second hinge arrangements, wherein the first and second hinge arrangements are alternatingly arranged between the panels, wherein the first hinge arrangements are guided in the top and bottom guide rails and the second hinge arrangements are deflected transverse to the top and bottom guide rails outwardly away from the peripheral frame;

wherein in the stretched-out closed position the panels are sealed relative to each other and relative to the peripheral frame by a seal arrangement, wherein the seal arrangement includes frame seals disposed between the panels and the peripheral frame and wherein the frame seals extend at least partially along a sealing plane;

a first adjusting strip disposed in front of the first lateral frame part and facing in a direction of extension of the top and bottom guide rails, wherein the first adjusting strip is adjustable in an adjusting direction relative to the first lateral frame part so that a spacing between the first adjusting strip and the first lateral frame part is adjustable for adaption to an end edge of a first panel of the plurality of panels that is positioned at the first lateral frame part in the stretched-out closed position;

wherein the first adjusting strip comprises a sealing contact surface that is aligned with the sealing plane;

wherein the frame seals include a seal arranged on the first lateral frame part and extending into the top and bottom guide rails, wherein the sealing contact surface is resting against the seal arranged on the first lateral frame part.

2. The folding device according to claim 1, wherein the first adjusting strip is arranged completely in an area between the sealing plane and an outer surface of the first lateral frame part and the first adjusting strip has a strip width that is smaller than a frame part width of the first lateral frame part.

3. The folding device according to claim 2, wherein the first adjusting strip comprises an exterior surface positioned opposite the sealing contact surface, wherein the exterior surface is aligned with an outer surface of the first panel positioned at the first lateral frame part in the stretched-out closed position.

4. The folding device according to claim 1, wherein the first adjusting strip comprises an end face seal facing the first panel positioned at the first lateral frame part in the stretched-out closed position.

5. The folding device according to claim 1, wherein the first panel positioned at the first lateral frame part in the stretched-out closed position comprises an end face seal facing the adjusting strip.

6. The folding device according to claim 1, wherein the first adjusting strip comprises an end face seal facing the first panel positioned at the first lateral frame part in the stretched-out closed position and wherein the first panel positioned at the first lateral frame part in the stretched-out closed position comprises an end face seal facing the adjusting strip.

7. The folding device according to claim 1, wherein the first adjusting strip is a profiled section comprising profiled section stays provided with guide surfaces extending in the adjusting direction of the first adjusting strip.

8. The folding device according to claim 1, wherein the first lateral frame part is a profiled section comprising a chamber that is open in the direction of extension of the top and bottom guide rails, wherein the first adjusting strip is supported in the chamber.

9. The folding device according to claim 1, wherein the first adjusting strip is adjustable relative to the first lateral frame part by adjusting screws.

10. The folding device according to claim 9, wherein the adjusting screws include first screws and second screws, wherein the first screws are adjustable pressure supports comprising a screw head resting against a rear surface of the first adjusting strip that is facing the first lateral frame part, and wherein the second screws are tensioning screws for pulling the first adjusting strip against the pressure supports.

11. The folding device according to claim 10, wherein the first adjusting strip comprises access openings for accessing with a tool the screw heads of the first screws.

12. The folding device according to claim 9, further comprising consoles with threaded bores, wherein the consoles are fastened to the first lateral frame part, and wherein the adjusting screws engage the threaded bores.

13. The folding device according to claim 9, wherein the adjusting screws comprise a head supported in the first adjusting strip.

14. The folding device according to claim 1, wherein the sealing plane is an annular surface extending about the entire peripheral frame and a continuous seal for the first adjusting strip and for the panels is arranged on the annular surface.

15. The folding device according to claim 1, comprising a second adjusting strip disposed in front of the second lateral frame part and facing in a direction of extension of the top and bottom guide rails, wherein the second adjusting strip is adjustable in an adjusting direction relative to the second lateral frame part so that a spacing between the second adjustable strip and the second lateral frame part is adjustable for adaption to an end edge of a second panel that is positioned at the second lateral frame part in the stretched-out closed position, wherein the second adjusting strip comprises a sealing contact surface that is aligned with the sealing plane, wherein the frame seals include a seal arranged on the second lateral frame part and extending into the top and bottom guide rails, wherein the sealing contact surface is resting against the seal arranged on the second lateral frame part.

* * * * *